US005697205A

United States Patent [19]

Mack

[11] Patent Number: 5,697,205

[45] Date of Patent: Dec. 16, 1997

[54] ROVING FRAME WITH A DEVICE FOR AUTOMATIC EXCHANGE OF FULL ROVING BOBBINS WITH EMPTY CORE SLEEVES

[75] Inventor: Karl-Heinz Mack, Weilheim, Germany

[73] Assignee: Zinser Textilmaschinen GmbH, Ebersbach/Fils, Germany

[21] Appl. No.: 592,995

[22] Filed: Jan. 29, 1996

[30] Foreign Application Priority Data

Jan. 27, 1995 [DE] Germany ..... 195 02 585.7
Jan. 27, 1995 [DE] Germany ..... 195 02 586.5

[51] Int. Cl.[6] ..... D01H 9/10; D01H 9/14; D01H 7/24

[52] U.S. Cl. ..... 57/267; 57/281; 57/115

[58] Field of Search ..... 57/281, 267, 268, 57/273, 274, 276, 67, 115

[56] References Cited

U.S. PATENT DOCUMENTS

| | | | |
|---|---|---|---|
| 1,823,374 | 9/1931 | Porter | 57/267 |
| 3,935,699 | 2/1976 | Iida et al. | 57/267 |
| 4,369,621 | 1/1983 | Kogiso | 57/274 X |
| 4,934,132 | 6/1990 | Marzoli | 57/267 |
| 5,170,616 | 12/1992 | Genevray | 57/267 |
| 5,197,272 | 3/1993 | Frey | 57/281 X |
| 5,359,843 | 11/1994 | Herold et al. | 57/267 |
| 5,375,405 | 12/1994 | Weeger | 57/281 |
| 5,522,210 | 6/1996 | Mack | 57/267 X |
| 5,524,428 | 6/1996 | Locatelli et al. | 57/115 X |

FOREIGN PATENT DOCUMENTS

| | | |
|---|---|---|
| 0 311 862 | 4/1989 | European Pat. Off. . |
| 296 714 | 12/1991 | German Dem. Rep. . |
| 1 535 049 | 11/1969 | Germany . |
| 41 37 492 | 5/1993 | Germany . |
| 42 29 296 | 3/1994 | Germany . |
| 626 282 | 10/1961 | Italy . |

*Primary Examiner*—Michael Mansen
*Attorney, Agent, or Firm*—Herbert Dubno

[57] ABSTRACT

A roving frame in which short trains of hangers are introduced transversely into two flyers of rows for replacement of full bobbins by empty core sleeves.

14 Claims, 9 Drawing Sheets

IV
IV
8
15
6
12'
11
2
12
13
5
14
10
20
6,15

ROVING FRAME WITH A DEVICE FOR AUTOMATIC EXCHANGE OF FULL ROVING BOBBINS WITH EMPTY CORE SLEEVES

FIELD OF THE INVENTION

The present invention relates to a roving frame of the type having a device for the automatic exchange of full bobbins with empty core sleeves upon which roving bobbin winding can be carried out. In particular, the invention relates to a machine of the type in which there are two rows of flyers, one row set back as a rear row from a front row, and in which the bobbin replacement is effected through guides or with suspension carriage trains which pass through the flyers.

BACKGROUND OF THE INVENTION

It is common with roving frames to provide, generally on each side of the machine, two rows of roving-spinning locations, generally referred to as spinning stations, at each of which the sliver arriving from sliver cans in a sliver can field proximal to the machine, is spun into roving which is wound upon a core sleeve to form a bobbin. One row of workstations is located rearwardly of another such row on each side of the machine.

On the machine frame, it is a common practice to provide for each of these stations, a respective flyer and hence the roving spinning machine may also be termed a flyer frame. The flyers are generally aligned with spindles and have downwardly extending arms. They can be journalled above the spindle at bights of the inverted flyers. The roving for each flyer can pass downwardly along one of the arms thereof and can be applied to the bobbin at a lower end of the flyer arm, e.g. at a pressing finger which can be biased toward the bobbin.

In the roving spinning operation, the sliver, which can pass through a drafting frame at the top of the flyer frame, passes along the aforementioned arm of the respective flyer onto a core sleeve which is mounted on the spindle. Each spindle thus can receive an empty core sleeve upon which a bobbin is to be wound and ultimately develops a full bobbin which must be removed and replaced by an empty core sleeve. The spindles can be mounted on a spindle rail which can be raised and lowered to distribute the roving onto the respective bobbins during the roving spinning operation.

In a typical bobbin replacement operation, after the flyer frame has shut down, the full bobbins can be raised to meet hangers depending from suspension carriage trains, thereby transversing the full bobbins to the hangers when the spindle rail is again lowered. The spindle rail can be raised when hangers carrying the empty core sleeves are aligned therewith to effect transfer of the empty core sleeves to the spindles.

The full bobbins are removed from the workstations on the suspension carriage train and at a location other than the workstations, the full bobbins can be removed from the suspension carriage train and empty core sleeves can be pressed thereon in preparation for the next bobbin replacement operation. During the removal of the bobbins from the suspension carriage train and the mounting of the core sleeves thereon, bobbins are wound on the core sleeves at the workstations.

In German Patent 42 29 296, a suspension carriage train is displaced on a guide rail which can extend through the flyers of a row in the bobbin replacement stage. For this purpose, below the heads of the flyers and/or below the flyer rail of the roving machine, special guide members are provided which form the guide rail when the flyers are rotated into a transverse position with respect to the longitudinal axis of the roving machine. The result is a relatively long travel of the train through the flyers in a time consuming operation.

Another method of changing the roving bobbins in a textile machine is described in EP 0 311 862 B1 in which carriers fitted with bobbins are displaceable on a suspension track extending along the machine. In one construction of this system, each full bobbin carrier is displaced in a respective one of two separate tracks while a carrier with a half full bobbin is transported in a second track between the first two. Here as well the displacement of the full bobbins is time consuming independently of the special construction required to accommodate movement of half full bobbins in the respective carriers.

OBJECTS OF THE INVENTION

It is, therefore, the principal object of the present invention to provide an improved construction of a textile machine having the facility of automatic roving bobbin change and such that the travel time of the full bobbins in the flyer rows is shortened.

Another object of this invention is to shorten the travel time of full bobbins in the flyer rows during a bobbin replacement operation in a particularly simple way.

Another object of the invention is to provide an improved roving machine or frame whereby drawbacks of earlier systems are obviated.

SUMMARY OF THE INVENTION

These objects and others which will become apparent hereinafter are attained, in accordance with the invention, by providing the suspension carriage trains so that each of them is displaceable transversely to the longitudinal dimension of the roving frame in only two flyers, namely, one flyer from the rear row and one flyer from the front row. This insures an advantage in that the displacement of the suspension carriage trains into the flyer rows and out of the flyer rows for a bobbin replacement is significantly shortened in time.

In particular, the roving frame of the invention can comprise:

- two rows of roving spinning stations each provided with a flyer whereby two rows of the flyers extend in a longitudinal direction of the roving frame; and
- a device for automatic exchange of full bobbins for empty core sleeves, the device including:
  - respective guides extending transversely of the longitudinal direction through a respective pair of flyers consisting of only one flyer of each of the two rows, and
  - a respective suspension carriage train displaceable on each of the guide transversely of the longitudinal direction and having:
    - a plurality of suspension carriages,
    - a respective hanger on each of the carriages for suspending selectively a full bobbin and an empty core sleeve therefrom, and
- coupling means for connecting the carriages of the respective train together whereby each of the trains is movable on the respective guide only in the flyers of the respective pair.

According to a feature of the invention, the suspension carriage trains consist of rigid bars or rails upon which the hangers for engaging the bobbins and core sleeves extended downwardly. These bars or rails can be inserted into a pair of flyers which are offset from one another longitudinally in a direction inclined to the longitudinal direction of the roving machine in a typical two row roving machine, i.e. a roving machine having two rows of flyers on at least one side but preferably on both sides of the machine. The rigid rails can thus be displaced on guides formed by support members between the flyers. The guide can also be part of a telescoping structure of the aforementioned rails.

The movement of the rail forming the suspension carriage train at an inclination to the longitudinal direction of the roving machine could possibly result in a collision with the transversely extending intermediate stands of the roving frame. To avoid such potential collision, the intermediate stands can be provided with corresponding cutouts or can themselves be oriented at an inclination to the longitudinal dimension.

According to another feature of the invention, the suspension carriage train is formed as a horizontal flexible train in which individual members are articulated to one another and which are guided in rails. These rails can have segments inclined at an angle to the dimension. The rail segments can be swung into position within the flyers about horizontal or vertical axes. With a flexible articulated suspension carriage train, the guide can be angled and the suspension carriage train can bend about the angle in the guide.

When a pressing finger is provided on one flyer arm of each flyer and can be equipped with a pressing finger plate, the pressing finger plate can have a deflection skid which protects a roving lying on the pressing finger plate from contact with the empty sleeves while they are introduced into the flyer rows.

Thus I am able to avoid the danger that the roving running on the outer side of the pressing finger plate will be damaged or torn to the point that automatic application of the roving to the newly mounted empty core sleeve is no longer possible. The deflection skid prevents an empty sleeve from coming in contact with the roving on the pressing finger plate. The deflecting skid is particularly advantageous for short suspension carriage trains which are inserted transversely and which a maximum of two empty sleeves can each engage a deflection surface.

Since the flyers are brought to standstill in positions in which the displacement of the full bobbins occurs in the deflection direction which suffices for each pressing finger plate of the rear flyer be provided with a deflection skid. The pressing finger of the front flyer is advantageously pressed away by the doffed full bobbin. Of course, the pressing finger of the front flyer can also be provided with a deflection skid. This reduces the number of different parts which are necessary and also insures that a pressing finger of a front flyer will be swung inwardly against a sleeve which has no winding thereon.

BRIEF DESCRIPTION OF THE DRAWING

The above and other objects, features, and advantages will become more readily apparent from the following description, reference being made to the accompanying drawing in which.

SPECIFIC DESCRIPTION

In this application I have used the term suspension carriage train to refer to a row of hangers which depend from a succession of suspension carriages which may be articulated to one another and, if desired, interconnected by connecting members which themselves may be pivotally connected to the carriages. However, I have also used term "train" to refer to the row of hangers which can depend from a rigid member which may be guided on a telescoping system as has been described or even on supports which are spaced apart and may be located along the path of this rigid element, also termed a "rail" here since, in this case, the train is a train of hangers, i.e. a group of hangers displaced together. While individual carriages may not be discerned in the latter case, each of the regions of the rigid rail supporting the plurality of hangers is in effect a carriage which is rigidly connected to the other carriage forming portions of this rail or bar. As a consequence, while the embodiment of FIG. 1 shows individual carriages with wheels for supporting them as will be described and provided with individual hangers, in the embodiment of FIG. 2, the hangers may be spaced apart along a rigid member in which case the zones from which the hangers depend are to be considered equivalent to the carriages and the regions between these zones are to be considered equivalent to the coupling members between the carriages of the embodiment of FIG. 1.

Figure 1:
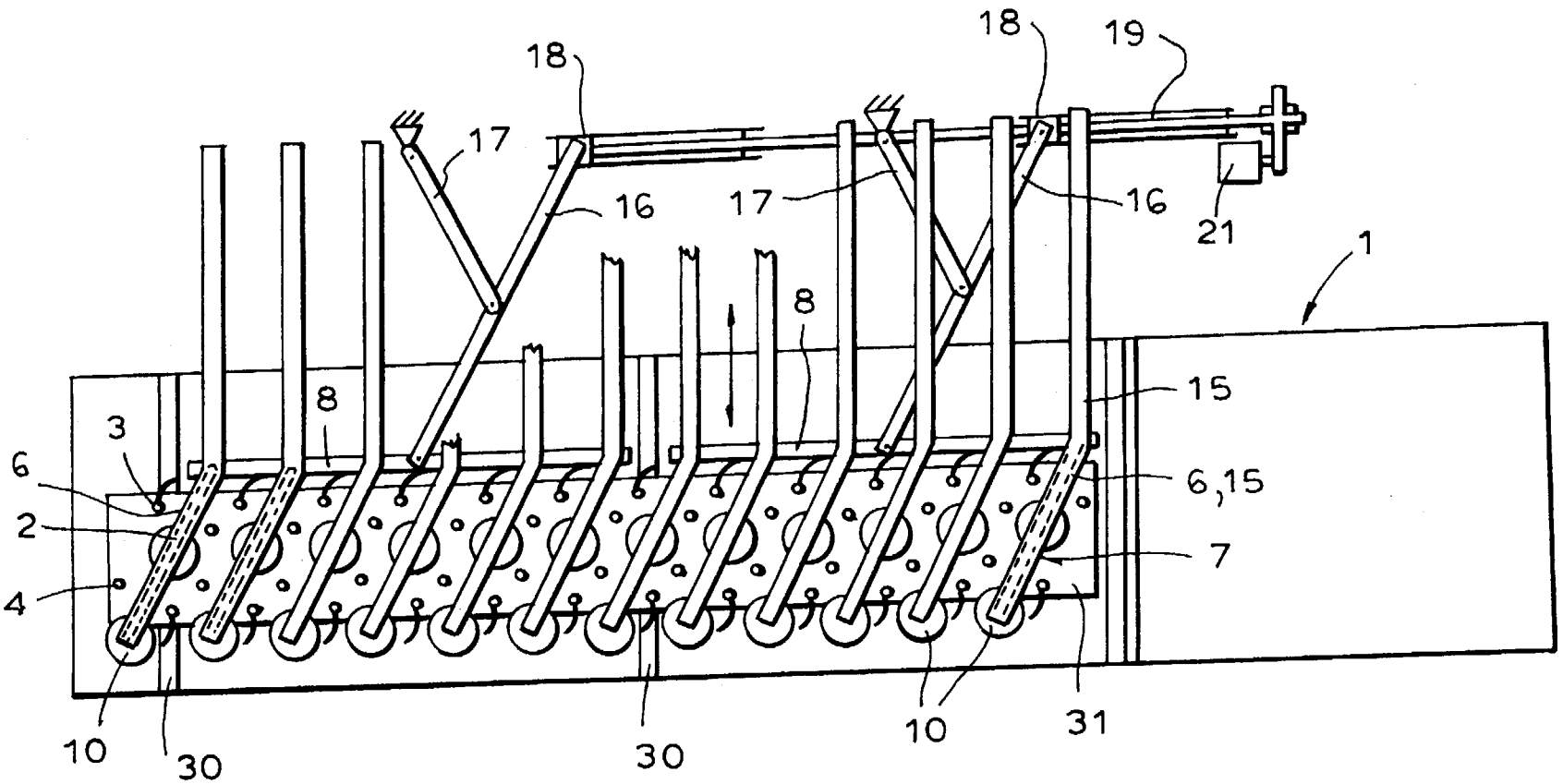
FIG. 1 is a plan view of two fields of a roving machine with angled guide rails.

FIG. 1 shows angled guide rails 15 as suspension tracks 6 in which articulated suspension carriage trains 2 are displaceable. Each suspension carriage train 2 services two diagonally adjacent roving spinning stations of two parallel rows of such stations.

Figure 5:
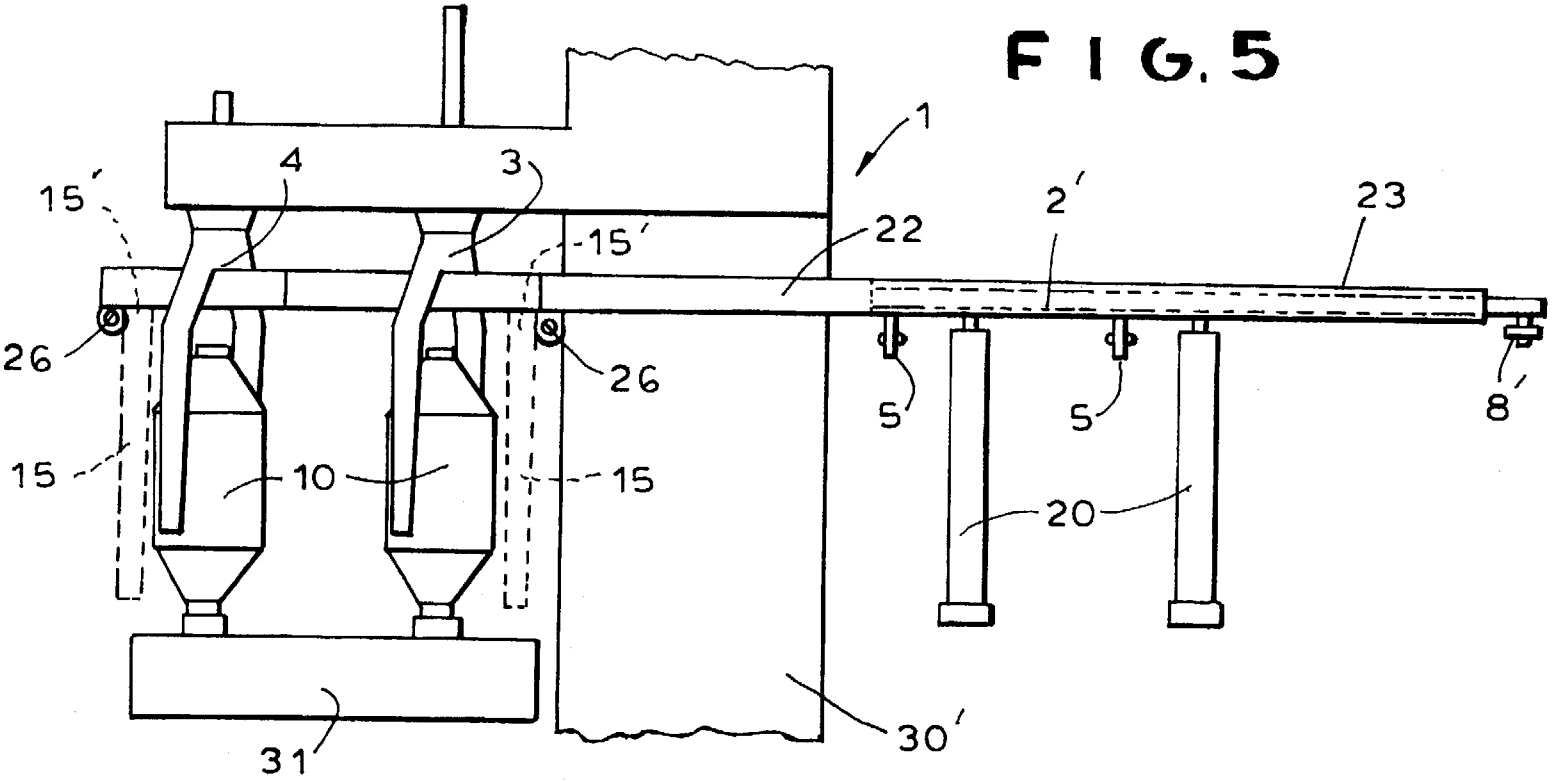
FIG. 5 is a side view of a rigid system for the suspension carriage train, partly broken away.

Each station has a respective flyer 3,4 rotatable about a respective vertical axis and located above a respective spindle (not visible in FIG. 1) but provided on a spindle rail which is shown at 31 in FIGS. 1 and 5.

Each flyer in turn is of inverted U-shape (see FIG. 5 or FIG. 9) having a pair of downwardly extending shanks or arms which can flank a respective bobbin core on which the roving is wound and hence can flank the full bobbin when that is formed. The arms are connected by a bight at the upper end of the flyer and the bight is journalled on the flyer rail or some other fixed part of the roving frame. One arm of the flyer can be formed with a pressing finger as has been shown in FIG. 9.

The sliver can be fed from the outer can field and respective sliver cans in the field adjacent the roving frame, through a drafting frame above the roving spinning stations, if desired, and then passes along an arm of the flyer to the lower end of this arm and is wound onto the bobbin.

At this lower end of the flyer arm which feeds the roving onto the bobbin the flyer arm can have the pressing finger which, during the winding operation, is spring biased against the bobbin. During the winding operation, the bobbins are raised and lowered with the spindle on the spindle rail. When the bobbins are full, they are exchanged for empty core sleeves by means of the suspension trains described.

Specifically, the spindle rail is lowered, the flyers are oriented in planes transverse to the direction in which the suspension carriage trains are advanced (in the embodiments of FIGS. 1 and 2, in planes which are inclined to the longitudinal direction and are perpendicular to the direction in which the carriage train is fed into the flyers and withdrawn from the flyers), the spindle rail is raised to engage the core sleeve of each full bobbin on a hanger of the respective suspension carriage train which has been inserted into flyers of a pair including only one flyer from the rear row and one flyer from the front row, the spindle rail is lowered to remove the full bobbins from the respective spindles, the train is displaced to align empty bobbin cores or core sleeves with the spindles (when bobbins are displaced by cores in one pass through the flyers), the spindle rail is raised to receive the core sleeves, the spindle rail is lowered to allow the core sleeves to clear the full bobbins suspended from their hangers, the train is withdrawn from the flyers with the bobbins, thereby moving the bobbins out of the roving spinning region, and the roving frame is returned to its spinning operation to wind roving on the new core sleeves and thus from new bobbins. If desired, using a similar sequence, the empty core sleeves can be supplied after the full bobbins have been withdrawn.

Figures 3, 4:
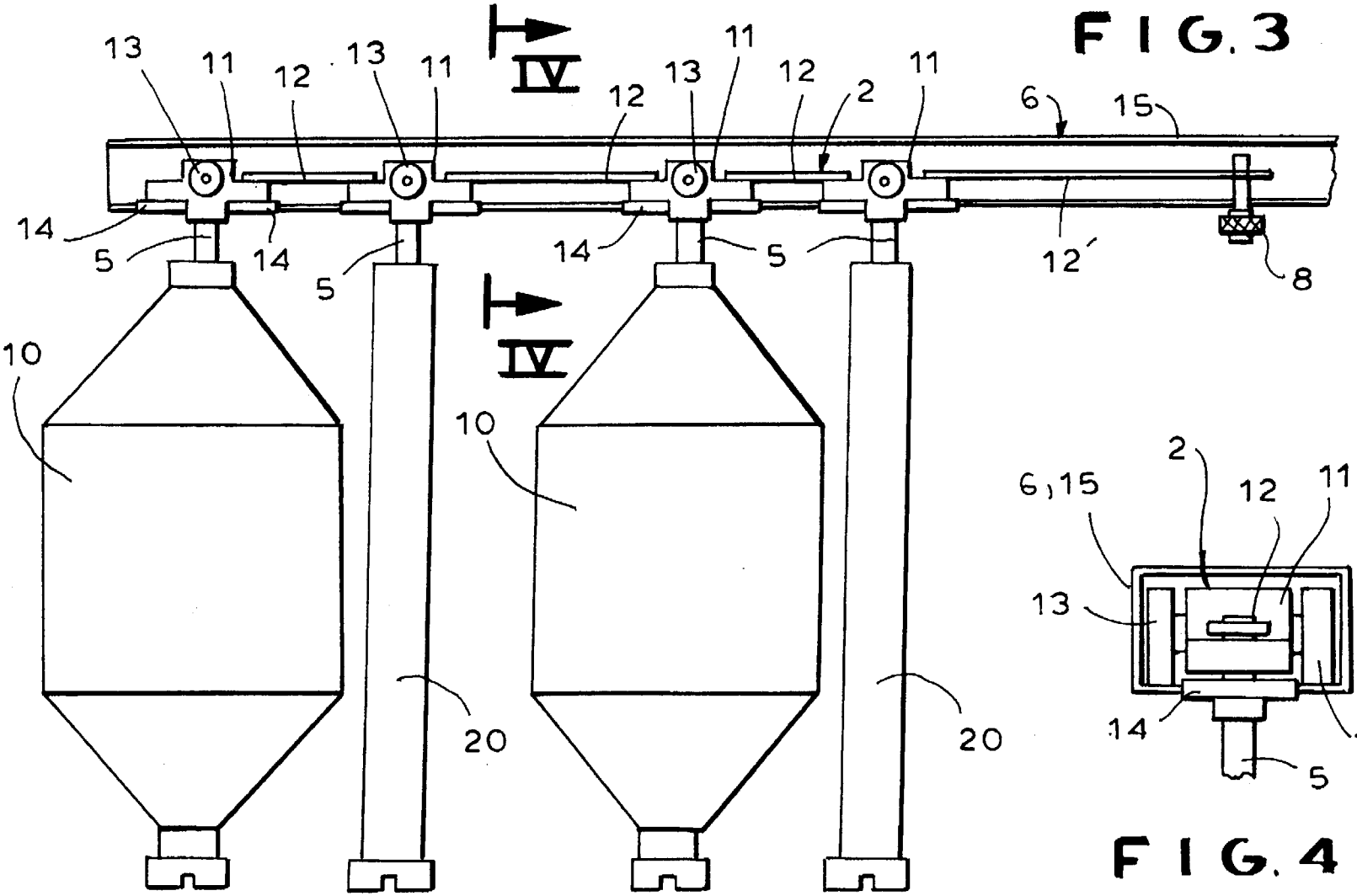
FIG. 3 is a side elevational view of a portion of a roving machine partly broken away.
FIG. 4 is a section along the line IV—IV of FIG. 3.

FIG. 3 shows the articulated suspension carriage in greater detail. It comprises suspension carriages 11 which are pivotally connected to coupling bars 12 by vertical pivots so that the chain consisting of carriages 11 and bars 12 can be deflected about an angle in a horizontal plane. Each carriage 11 is supported by a pair of support rollers 13 which ride on lower inwardly extending flanges of the guide rails 15. As can be seen from FIG. 4 the guide rails 15 have a special configuration, namely that of a rectangular section tube with a slot formed in the lower wall so that these inwardly extending flanges flank the slot and serve as a runway for the rollers 13. The inwardly turned edges of the flanges can engage guide rollers 14 which are provided in each carriage 11 forwarded of an behind a respective hanger and which are rotatable about respective vertical axes. The hangers 5 are configured to engage the empty core sleeves 20 as well as the core sleeves of the full bobbins 10 at their upper ends. Each carriage 11 has one such hanger 5.

The last coupling bar 12' of each articulated suspension carriage train 2 is connected with a shifting bar 8. The shifting bars 8, in turn, are connected in the embodiment of FIG. 1 with a scissor lever system comprised of two levers 16 and 17 which are pivotally connected together. The longer lever 16 is pivotally connected to the shifting bar 8 and to a nut 18 which is displaced by a threaded spindle 19. The short lever 17 has its free end pivotally connected to a fixed point on the machine frame while its opposite end is pivotally connected to the lever 16 substantially at the center thereof.

The threaded spindle 19 is driven by a motor 21. As the spindle 19 is driven, the nuts 18 are displaced horizontally, parallel to the rows of flyers of the machine, thereby actuating the scissor lever system 16, 17 and thus displacing the shifting bars 8 in the direction of the arrow shown in FIG. 1, i.e. transverse to the rows of flyers. Each lever system 16, 17 covers a field of workstations of the roving machine and to guide the shifting bars 8 parallel to themselves, each field may be connected to two such lever systems forming, for example, a parallelogrammatic linkage.

It will be apparent that the shifting bars 8 can also be displaced by other mechanisms, for example, a rack and pinion arrangement, an endless chain drive or the like.

Since each shifting bar 8 is connected via the coupling bars 12' to a plurality of articulated suspension carriage trains 2, all of these suspension carriage trains are displaced together transversely to the longitudinal direction of the roving frame into and out of respective pairs of flyers of the two rows, i.e. into the rear row on the side of which the actuating system 16 through 19 is provided and then into the front row of the flyers 4.

Figure 2:
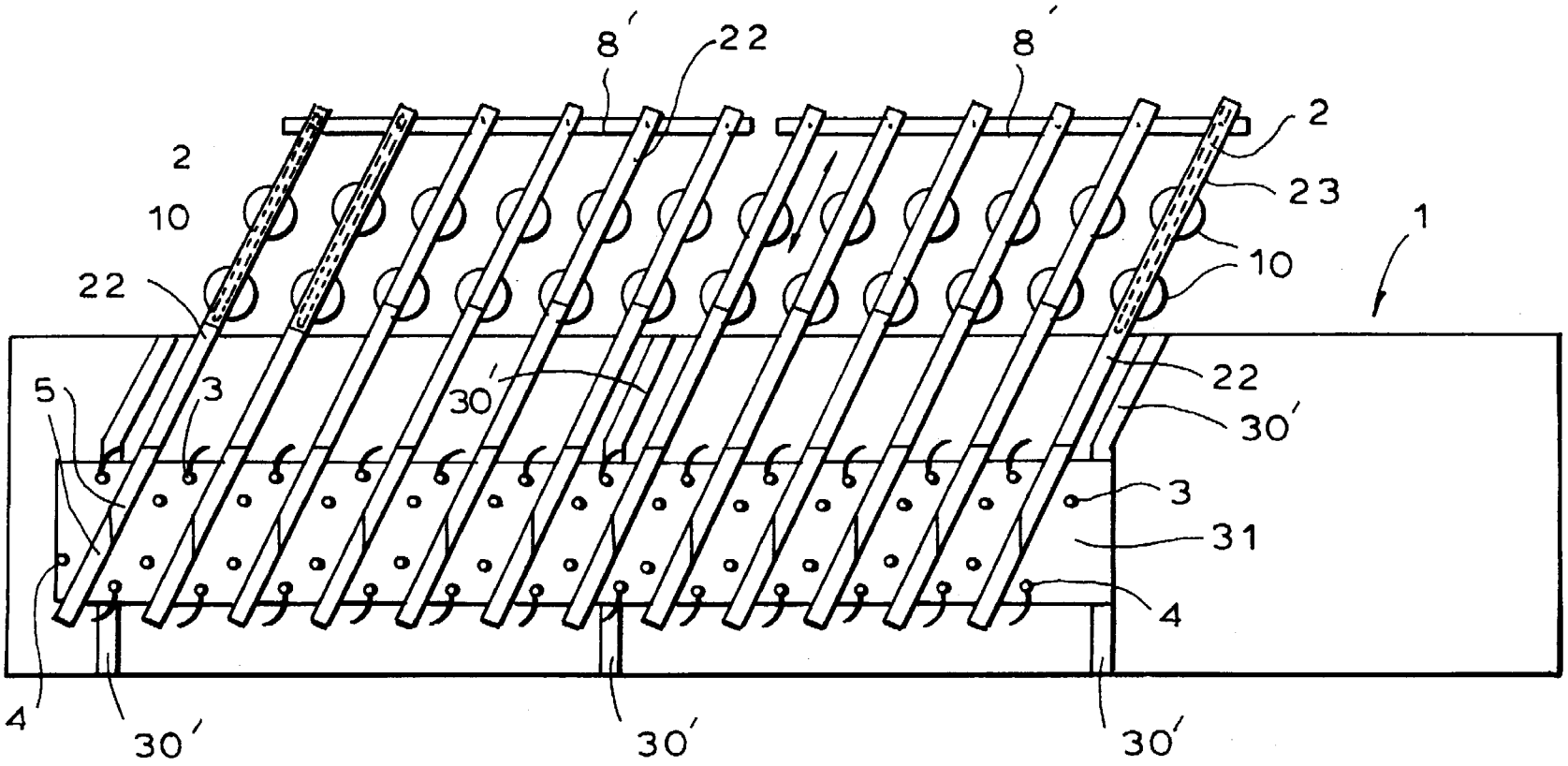
FIG. 2 is a plan view of two fields of a roving machine having straight rigid guide rails.

In the embodiment of FIG. 2, rigid straight guide rails 22 are provided which carry the hanger train 2' in the form of a bar or rail from which a plurality of hangers depend. This rigid "train" is represented at 23 in FIG. 2. These rails 23 are displaced analogously to the embodiments of FIGS. 1, 3 and 4, using a shifting bar 8' which can be formed with a drive of the type already described and not illustrated in FIG. 2. The hangers are not visible in FIG. 2 either, although the full bobbins 10 have been shown thereon. The rails 23, like the suspension trains of FIG. 1, carry the hangers with the empty core sleeves into the flyers and carry the full bobbins out of the latter in the manner already described.

While the embodiment of FIG. 1 can have intermediate stands of the machine frame to hold the spindle rail 31 of the 2 row roving machine 1, it will be understood that openings can be provided in these intermediate frames to clear the angled guide rails 15. In the embodiment of FIG. 2, the intermediate stands 30' are angled to lie parallel to the inclined guide rails 22 which are not angled as in FIG. 1.

FIG. 5 represents the embodiment of FIG. 2 in side view. As will be apparent from this FIG., the flyers are oriented with such inclination that they present the greatest openings to the hanger trains 2' when the latter pass into the rows of flyers. The hangers 5 are shown in FIG. 5 and can carry the empty core sleeves 20 or the full bobbins 10 as has been described.

In the embodiment of FIG. 5, rail segments 15' are swingable about horizontal axes 26 into the position shown in solid lines in FIG. 5 from their broken lines positions to align the rail with the hanger train. After the bobbin replacement by core sleeves has been accomplished, the segments 15' can be swung downwardly to the position shown in broken lines to clear the flyers for spinning. FIGS. **6*a* through 6*l* indicated the sequence of operations for each of two working stations of two rows of a roving frame utilizing the embodiment of FIGS. 1, 3 and 4**, i.e. the articulated suspension carriage train.

Figure 10:
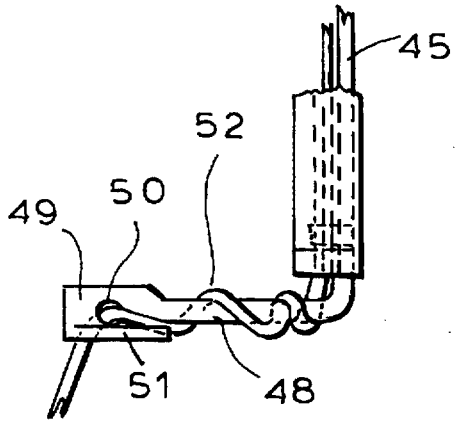
FIG. 10 is a side elevational view of a pressing finger plate with the deflection skid, partly broken away.

In the position shown in FIG. **6*a*, full bobbins 10 are being wound in the various working positions with the flyers 3 and 4 applying through the pressing fingers 3' or 4', the twisted roving to the bobbins, the roving being fed to the flyers as will be described in greater detail with reference to FIGS. 10 and 11 from sliver cans as has been mentioned previously. The suspension carriage train has empty hangers 5 adapted to pick up the full bobbins 10 and hangers which have been previously supplied with empty core sleeves as represented at 20 in the diagrammatic illustration of FIG. 6*a*. The inner guide rail segment 15 and the outer guide rail segment 15*a*** are in either rest positions outside the flyers to allow the latter to spin.

The roving frame is brought to standstill (FIG. **6*b*) with the flyers positioned to allow the rail segments 15*i* and 15*a*** to extent through the flyers. The swinging movement is represented by the arrows and the segments 15*a* and 15*i* will be understood to be swingable into positions as shown in FIGS. 6*c* through 6*j* about axes such as represented at 26 in FIG. 5 or appropriate vertical axes.

Figures 6A, 6B, 6C, 6D:
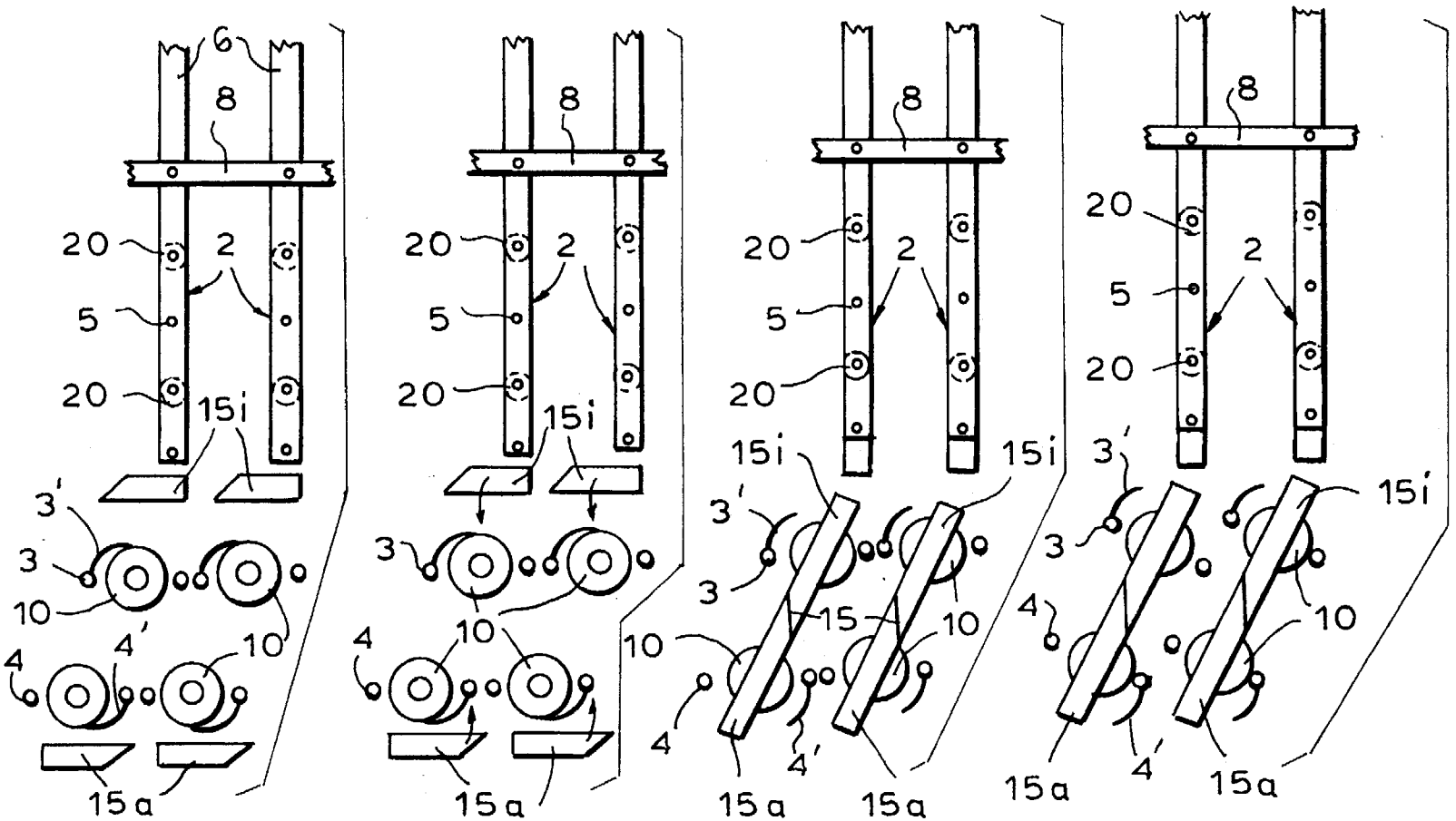
FIGS. 6*a* through 6*l* are plan views of a bobbin change device showing different positions in an angled system.
Figures 6E, 6F, 6G, 6H:
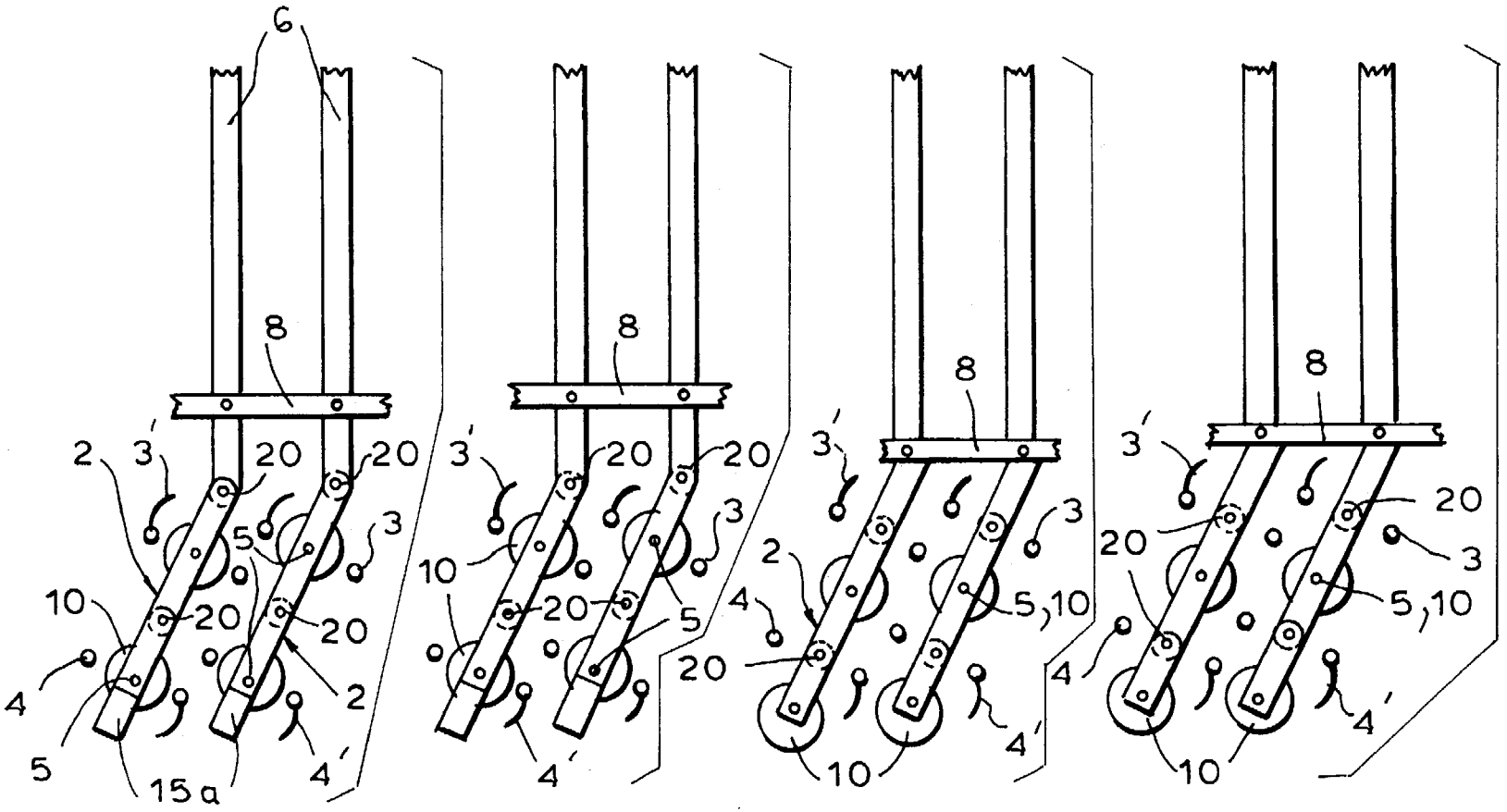
Figures 6I, 6J, 6K, 6L:
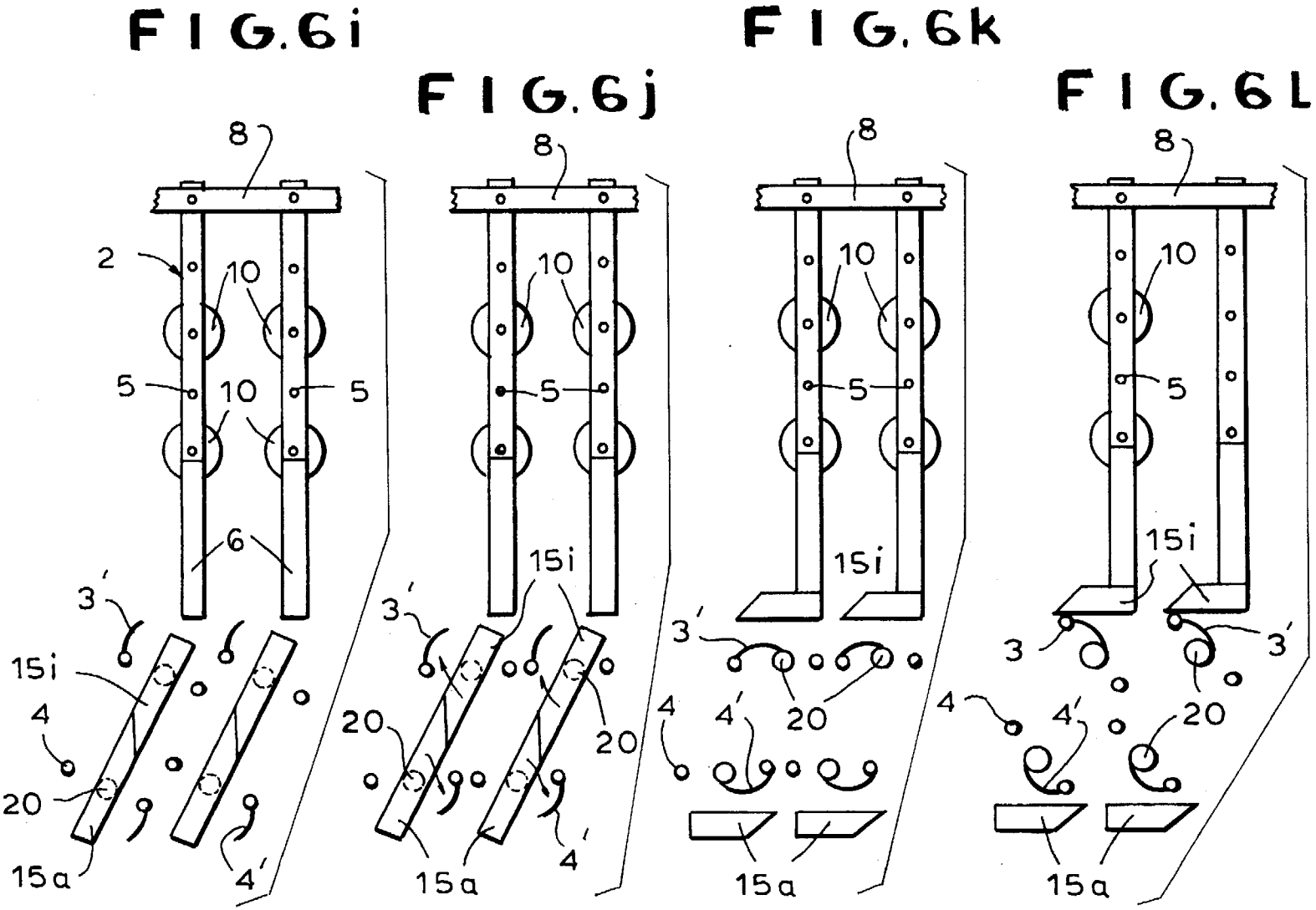

FIG. 6i cshows the rail segments 15*a* and 15*i* after they have been swung into position within the flyers to form the continuous guide rails 15 as shown schematically in FIG. 1. The pressing fingers 3' and 4' are swung out of engagement with the full bobbins 10. The flyers 3 are then rotated in the clockwise sense so that they can present to movement of the trains along the inclined guides 15, the maximum opening between the flyer shanks (FIG. 6*d*).

The suspension carriage trains are then advanced onto the guides 15 (FIG. 6*e*) so that each empty hanger 5 will be aligned with the full bobbin 10 of the spindle rail 31. The spindle rail 31 is thus raised to lift the full bobbin 10 onto the suspension carriage trains and then lowered, during the full bobbin off the spindles (not shown) and enabling the full bobbins to hang from the suspension carriage train. The suspension carriage trains 2 are then advanced further into their end positions as shown in FIG. 6*g* to align each spindle with a respective empty core sleeve. The spindle rail 31 is raised to transfer the empty core sleeves to the respective spindles and lowered, thereby withdrawing these core sleeves from the suspension carriage trains 2. The suspension carriage trains 2 then have only the full bobbins 10 suspended therefrom (FIG. 6*h*).

The carriages of the suspension carriage trains 2 are then withdrawn from the rails (FIG. 6*i*) thereby carrying the full bobbins 10 out of the working positions of the roving frame and the rail segments 15*i* and 15*a* are swung back to their rest positions (FIG. 6*j*) out of the flyers 3, 4. The fingers 3' and 4' are swung downwardly (FIG. 6*k*) after the flyers have been swung out of their inclined positions and spinning of new bobbins onto the core sleeves can commence (FIG. 6*l*). During the spinning operation, the full bobbins 20 are removed from the suspension carriage trains 2 and empty core sleeves 20 are mounted thereon.

Figure 8:
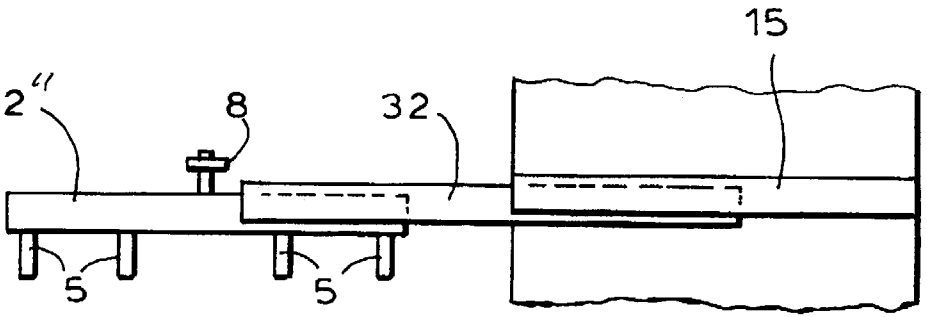
FIGS. 7 and 8 are side views of further embodiments of the invention.

FIG. 8 shows that it is possible to provide a hanger train as part of a telescoping structure with its guide rail 15. In this embodiment, the guide rail 15 has a telescoping portion 32 which can extend therefrom into the flyers when the roving machine is brought to standstill so that a hanger carriage or train 2" can be displaced therealong. The hangers 5 are here shown to depend from the train 2" and can receive the full bobbins 10 or the empty core sleeve 20. The telescoping movable portion 32 of the rail can move outwardly with the train 2" or inwardly with the latter.

Figure 7:
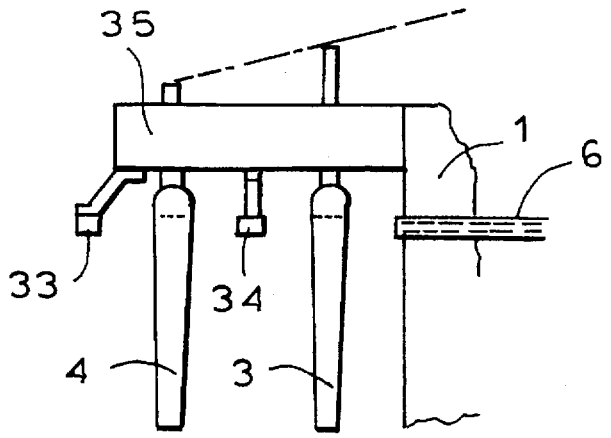

FIG. 7 indicates that instead of movable guide rail segments 15*a* and 15*i*, stationary guide segments 33 and 34 can be mounted under the flyer rail 35 of the roving machine to support the rigid hanger train 2' or 2" or the telescoping rail 32 when they are introduced the flyers of the respective pair. The rigidity of the trains 2' or 2" or the rail 32 allows them to bridge the distance between the fixed supports 33, 34. This support is particularly advantageous when the weight of the full bobbins must be supported.

Figure 9:
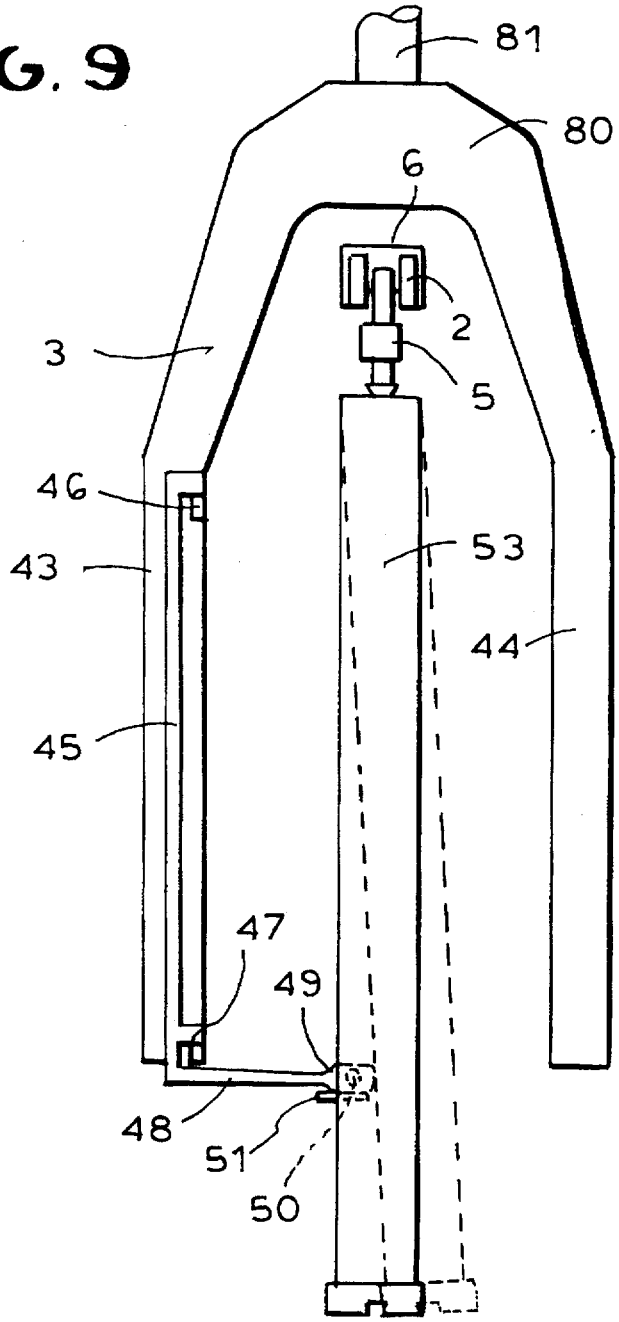
FIG. 9 is a side view of a flyer with a pressing finger and deflection skid, illustrating as well an empty core sleeve.

FIG. 9 affords side view of a flyer 3 which has two flyer arms 43 and 44 depending from a bight 80 by which the flyer is connected to a shaft 81 journalling the flyer for rotation about a vertical axis.

On one of the flyer arms 43, upper and lower bearings 46 and 47 are provided for a pivotal shaft 45 carrying at its lower end a pressing finger 48. The pressing finger 48 has at its front side a pressing finger plate 49 with an eye 50 through which the roving passes onto the bobbin. FIG. 11 shows the roving 52 supplied to the eye 50 and travelling through a roving passage 60 in the flyer arm 43.

The pressing finger plate 49 has a deflection skid 51 protecting the roving 52 against contact with an empty core sleeve 20 when the latter is introduced into the flyer row.

The deflection skid 51 is so shaped that it extends over the outer side of the pressing finger plate 49 at least over the region thereof at which the roving 52 lies upon the pressing finger plate. It must reach over the pressing finger plate by at least the thickness of the roving thereon.

The deflection skid 51 can be formed by a bend in the pressing finger plate 49 or by a stirrup received therein. It can also be provided on the upper or lower edge of the pressing finger plate 49. The empty core sleeve 20 is carried by the hanger 5 of the suspension carriage train 2 which is displaceable in the rail system 6.

Figure 11:
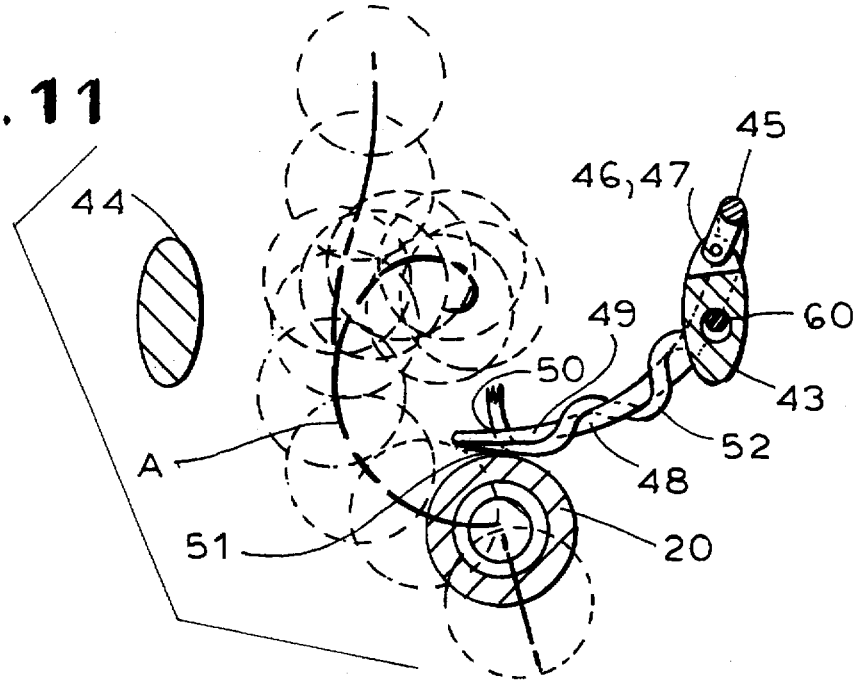
FIG. 11 is a section showing two flyer arms with a pressing finger plate in plan view.

As can be seen from FIG. 11, the skid 51 can deflect an empty core sleeve 20 fed in the direction of arrow A so as to swing it in an arc around the pressing finger. During the movement, the roving 52 is protected against contact with the core sleeve.

Figure 12:
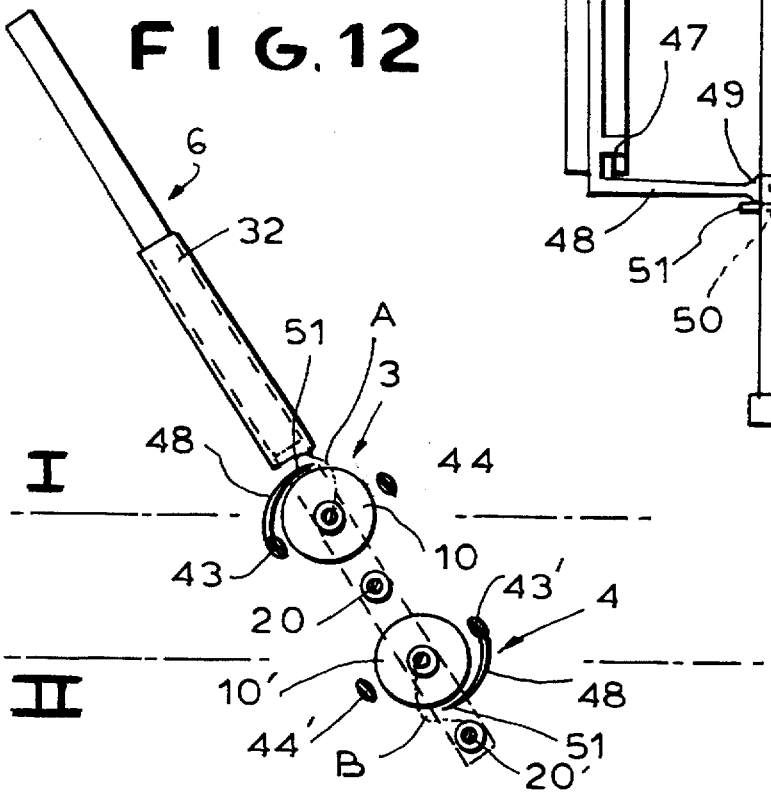
FIG. 12 is a plan view showing a device operating with two flyers, namely a flyer from an inner row and a flyer from an outer row.

The deflection skid 51 is especially useful for systems in which the short trains of hangers are introduced transversely into the flyer rows. As has been indicated in FIG. 7 and can be seen from FIG. 12, the flyer row I has an inner flyer 3 while the flyer row II has an outer flyer 4. The inner flyer 3 has the two flyer arms 43, 44 and correspondingly, the outer flyer has the two flyer arms 43' and 44'. FIGS. 8 and 12 illustrate the situation in which a rail 32 is about to displace the hanger train with the full bobbins out of the rows. The front portion of the rail 32 has been shown in broken lines so as not to obscure the other elements. During the previous insertion of the telescoping rail 32 into flyers the empty core sleeves are swung in the pattern indicated by the arc A in FIG. 11 away from the roving 52 on the pressing finger plate. When the rail 32 withdraws the full bobbins 10, the outer sleeve 20' swings along the arc represented by broken lines B in FIG. 12 and for this reason it is to provide the pressing finger 48 with deflection skid 51 as well. The full bobbin 10 engage the pressing finger 48 only from the inner side and thus do not create a problem.

The deflection skids avoid damage to the roving on the pressing fingers and tearing of this roving which might transfer with automatic emplacement of the roving on the empty core sleeves when they are properly positioned. Since the roving eye 50 has a slit in its upper portion to allow threading into it has been found to be advantageous to provide deflection skid on the lower edge of the pressing finger plate. The pressing finger skid 51 projects over the pressing finger plate 49 at least sufficiently to avoid any pressing of the empty core sleeve on the roving on the pressing finger plate.

It has been found to be advantageous to provide deflection skid 51 with the configuration shown in FIG. 11 against the outer edge of the pressing finger plate although it can have other configurations. Overall, the system of the invention allows automatic replacement of full roving bobbins with empty core sleeves with a substantial reduction in the time for introducing and removing the trains.

I claim:

1. A roving frame comprising:

two rows of roving spinning stations each provided with a flyer whereby two rows of said flyers extend in a longitudinal direction of the roving frame;

a device for automatic exchange of full bobbins for empty core sleeves, said device including:

respective guides having positions outside of said flyers, means for moving said guides so that said guides extend transversely of said longitudinal direction through a respective pair of flyers consisting of only one flyer of each of said two rows, and a respective suspension train displaceable on each of said guides transversely of said longitudinal direction and having:

a plurality of hangers for suspending selectively a full bobbin and an empty core sleeve from each said hanger, and means for displacing the suspension trains on the respective guide only in the flyers of the respective pair; and means below said flyers raisable to engage said full bobbins with said suspension trains and lowerable for receiving the empty core sleeves therefrom, the core sleeves being moved into respective flyers on said trains.

2. A roving frame comprising:

two rows of roving spinning stations each provided with a flyer whereby two rows of said flyers extend in a longitudinal direction of the roving frame;

a device for automatic exchange of full bobbins for empty core sleeves, said device including:

respective guides extending transversely of said longitudinal direction through a respective pair of flyers consisting of only one flyer of each of said two rows, and a respective suspension train displaceable on each of said guides transversely of said longitudinal direction and having: a plurality of hangers for suspending selectively a full bobbin and an empty core sleeve from each said hanger, and means for displacing the suspension trains on the respective guide only in the flyers of the respective pair, each of said suspension trains being a laterally flexible suspension carriage train comprising a plurality of suspension carriages, each with a respective one of said hangers, and coupling members articulated to and interconnecting said carriages, each of said guides having an angle formed therealong and the respective train being articulated to bend at an angle of the respective guide.

3. The roving frame defined in claim 1 wherein each of said suspension trains is formed as a rigid bar displaceable along a straight-line path into the flyers of the respective pair.

4. The roving frame defined in claim 1 wherein each of said guides has at least portions thereof fixedly positioned in regions of the respective flyers.

5. The roving frame defined in claim 4 wherein said portions of said guide form support rails for said suspension train.

6. The roving frame defined in claim 1 wherein said guides have portions in regions of said flyers which are swingable into a supporting positions for said trains and out of said supporting positions.

7. The roving frame defined in claim 1 wherein said guides have telescopingly extendable and retractable portions in regions of said flyers.

8. The roving frame defined in claim 1 wherein said means for displacing includes a push/pull device coupled to a multiplicity of said trains for collectively displacing same.

9. The roving frame defined in claim 8 wherein said push/pull device is a scissor-linkage system coupled to said multiplicity of said trains.

10. The roving frame defined in claim 1 wherein each of said flyers has a first flyer arm provided with a pressing finger pivotally mounted on the respective arm for swinging movement toward and away from a respective one of said bobbins, each of said pressing fingers has a pressing finger plate, and each pressing finger plate is formed with a deflection skid protecting a roving lying on the respective pressing finger plate against contact with an empty core sleeve during movement of the empty core sleeves into the respective pair of flyers.

11. The roving frame defined in claim 10 wherein only the pressing finger plates of the first flyers arms of only one of the flyers of each pair through which said empty core sleeves pass have said skids.

12. The roving frame defined in claim 10 wherein the pressing finger plates of both flyers of the pairs through which said empty core sleeves pass have said skids.

13. The roving frame defined in claim 10 wherein the skids are provided on said pressing finger plates in a vicinity in which the rovings lie thereon.

14. The roving frame defined in claim 10 wherein the skids are provided on outer sides of said pressing finger plates relative to orbits of the flyer arms.

* * * * *